United States Patent [19]

Blackburn et al.

[11] 4,149,735

[45] Apr. 17, 1979

[54] SKATEBOARD PIVOT ROLLER

[76] Inventors: Ian Blackburn, 16081 Gold Cir., Huntington Beach, Calif. 92647; Robert V. Blackburn, 11542 Luzon St., Cypress, Calif. 90630

[21] Appl. No.: 837,893

[22] Filed: Sep. 29, 1977

[51] Int. Cl.[2] ..... B60K 9/00

[52] U.S. Cl. ..... 280/87.04 A; 280/11.1 BR; D21/227

[58] Field of Search ..... 280/87.04 A, 87.04 R, 280/11.1 BR, 11.1 BT, 11.2, 767; D34/15 AT, 15 AJ

[56] References Cited

U.S. PATENT DOCUMENTS

| | | | |
|---|---|---|---|
| D. 244,706 | 6/1977 | Vela | 280/87.04 A |
| 2,608,430 | 8/1952 | Robert | 280/767 X |
| 3,310,320 | 3/1967 | Hanna et al. | 280/87.04 A |
| 3,379,454 | 4/1968 | Woodman | 280/87.04 A |

FOREIGN PATENT DOCUMENTS

| | | | |
|---|---|---|---|
| 494395 | 3/1930 | Fed. Rep. of Germany | 280/11.1 BR |
| 1121516 | 1/1962 | Fed. Rep. of Germany | 280/11.1 BR |

*Primary Examiner*—John A. Pekar

*Attorney, Agent, or Firm*—Fulwider, Patton, Rieber, Lee & Utecht

[57] ABSTRACT

There is disclosed a skateboard pivot roller assembly including a mounting bracket formed with a generally flat upwardly facing mounting surface for mating with the flat underside of the skateboard platform and is formed in one extremity with a roller housing including a downwardly opening ball socket having a rotatable ball mounted therein and projecting downwardly therefrom to have its lower spherical surface spaced somewhat above the plane of the bottoms of the skateboard wheels. Thus, the skateboard rider can shift his weight to the end of the skateboard having such assembly mounted therebeneath to tilt the skateboard thus lowering such bracket to engage the pivot ball with the ground to enable pivoting and maneuvering of the rider with at least a portion of his weight carried on such ball.

10 Claims, 7 Drawing Figures

FIG. 1
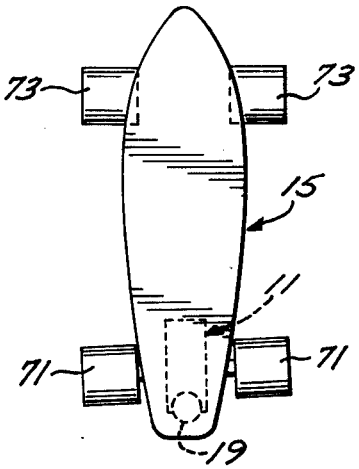
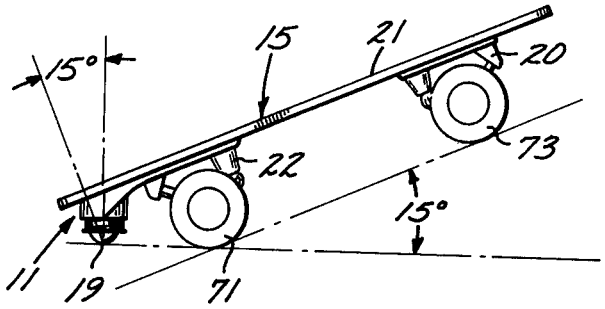
FIG. 2
FIG. 3
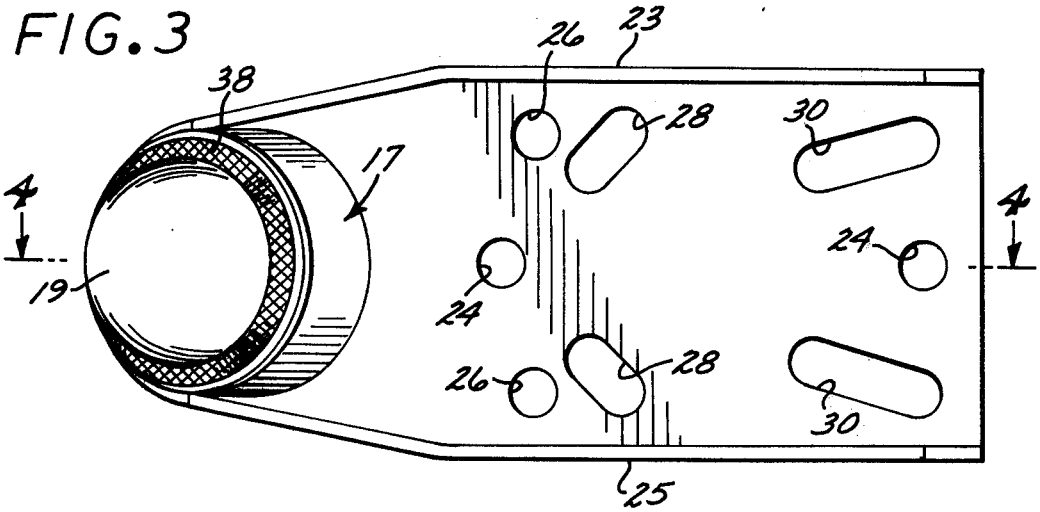
FIG. 4
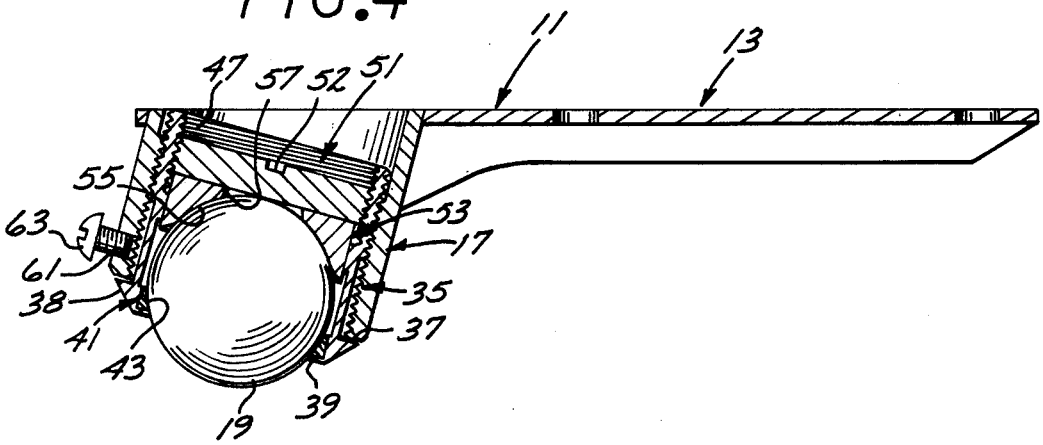

SKATEBOARD PIVOT ROLLER

BACKGROUND OF THE INVENTION

1. Field of the Invention

The pivot roller assembly of the present invention is for mounting on the underside, in cantilever fashion, at one end of a skateboard to enable the rider to shift his weight thereto to accomplish new and different maneuvers on the skateboard.

2. Description of the Prior Art

Numerous different adapters have been proposed for mounting on skateboards, such as the brake assembly shown in the U.S. Pat. No. 4,003,582 and the skid plate shown in U.S. Pat. No. 3,990,713. However, applicants are unaware of any pivot-ball adapters for mounting on the underside at one end of a skateboard and incorporating a pivot ball which will be lowered upon tilting of the skateboard to engage the ground and enable a portion of the rider's weight to be carried thereon to thus enable such rider to easily perform new and different maneuvers on the skateboard.

SUMMARY OF THE INVENTION

The skateboard pivot roller of the present invention is characterized by a bracket which may be mounted on the underside of the overhang at one end of a skateboard and is itself formed at one end with a downwardly opening socket having a large pivot roller retained therein and elevated at a height with respect to the plane of the bottoms of the skateboard wheels to provide for tilting of the skateboard itself about the wheels at the end of the skateboard proximate the pivot roller to shift at least a portion of the rider's weight to the pivot ball. With the rider's weight so carried by the pivot ball, various different maneuvers may be performed thus lending to the attractiveness of the skateboard.

In one embodiment a low-friction bearing ring is mounted in the upper end of the socket to cause the pivot ball to bear thereagainst when weight is applied thereto.

Also, the height of the pivot ball is preferably adjustable to accommodate various diameter skateboard wheels and to compensate for wear on the pivot ball itself.

The objects, advantages and novel features at the present invention will become apparent from the following, detailed description of the invention when considered in conjunction with the accompanying drawings.

BRIEF DESCRIPTION OF THE DRAWINGS

FIG. 1 is a top-plan view of an embodiment of the present invention wherein the pivot roller assembly is mounted underneath the back extremity of the skateboard platform;

FIG. 2 is a side view, in enlarged scale, of the skateboard shown in FIG. 1 and with the skateboard itself tilted;

FIG. 3 is a detailed view, in enlarged scale, of the roller assembly shown incorporated in the skateboard shown in FIG. 2;

FIG. 4 is a longitudinal, sectional view taken along the line 44 of FIG. 3;

DESCRIPTION OF THE PREFERRED EMBODIMENT

Figure 5:
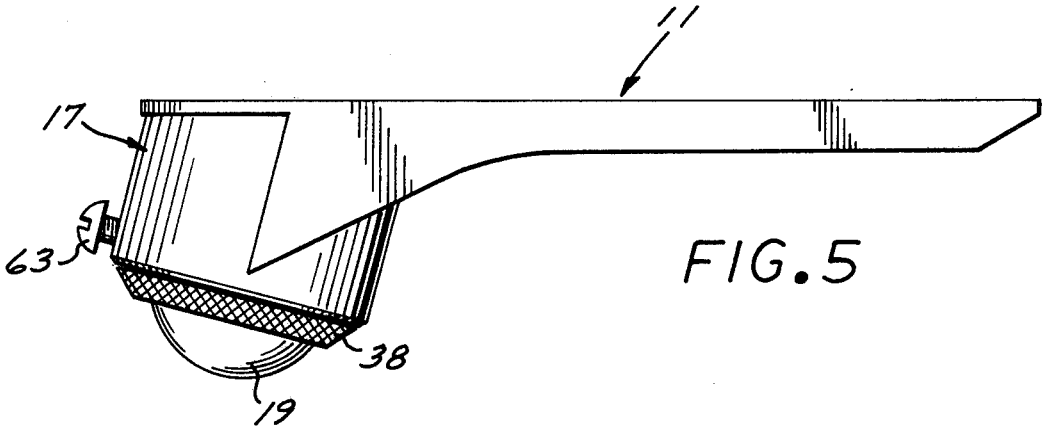
FIG. 5 is a side view of the pivot rollers assembly shown in FIG. 3 and depicting the pivot ball adjusted to its retracted upper position.
Figure 6:
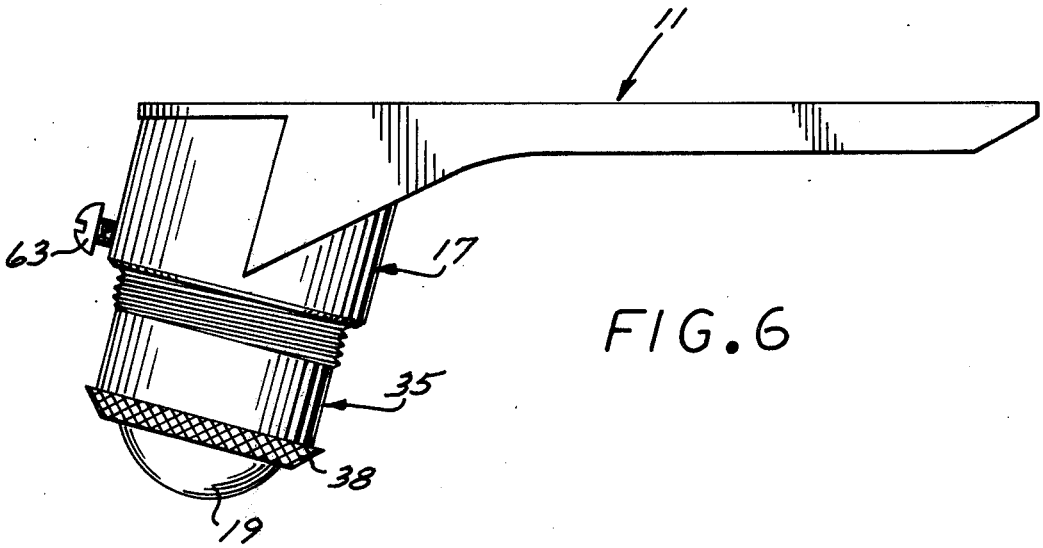
FIG. 6 is a side view similar to FIG. 5 but showing the pivot ball adjusted to its extended, lowered position.

Referring to FIGS. 2 and 4, the pivot roller assembly, generally designated 11, of the present invention includes, generally, a mounting bracket 13 for mounting at the front or rear undersides of a skateboard platform 21 of a skateboard 15 and is formed at its one extremity with a downwardly angled cylindrical roller barrel 17. Retained within such housing is a urethane roller ball 19 which may be, for example, 1¼ inches in diameter to easily carry the 100 or so pounds represented by the weight of a rider. Thus, a rider on the skateboard platform 21 can accomplish all the maneuvers heretofore known for skateboards and, in addition, can shift his weight to the back of such skateboard to pivot it about the rear truck thereof to engage the roller ball 19 with the ground and then pivot about such rear pivot ball 19 to perform 360 degrees of rotation and other desirable maneuvers.

The skateboard platform 21 is carried on a pair of trucks 20 and 22. The bracket 13 is constructed for mounting in a position sandwiched between the rear truck 22 of the skateboard platform 21 and includes a universal mounting-bolt pattern for receipt of mounting bolts utilized in mounting the various trucks 22 from conventional skateboards 15. The particular pattern shown includes a pair of longitudinally spaced apart bores 24 located on the longitudinal axis of the bracket with a pair of laterally, outwardly spaced bores 26 disposed slightly forwardly of the rearmost central bores 24.

A pair of rearwardly disposed outwardly and rearwardly angled slots 28 are spaced slightly forwardly of the rearmost central mounting bore 24 and a second pair of elongated slots 30 are disposed on opposite sides of the foremost central bore 24 and also angle outwardly and forwardly but at a lesser angle than that for the slots 28.

Referring to FIGS. 3 and 4, the mounting bracket 13 is conveniently formed of cold-finished carbon steel to withstand the wear and abuse generally attendant enthusiastic riding and acrobatics on a skateboard. The bracket 13 is of generally flat construction to mate on its upper side with the flat undersurface of the platform 21 of the skateboard 15 and is turned downwardly along its opposite edges to form longitudinal reinforcing flanges 23 and 25. The opposite sides of the bracket taper inwardly at the back extremity thereof, such inward taper being followed by the reinforcing flanges 23 and 25.

The pivot-ball socket barrel 17 is located at the back extremity of the bracket 13 and is of generally cylindrical tubular construction and angles downwardly and rearwardly at an angle of 75 degrees to the plane of the bracket itself thus providing an angle of 15 degrees to the perpendicular of the skateboard platform 21. This angle of socket-barrel projection has been found to be most desirable since the height of the pivot ball 19 is normally adjusted to a level causing it to engage the ground when the skateboard platform 21 is tilted at about 15 degrees to the horizontal thus causing the rider's weight to be directed downwardly along the axis of such barrel 17.

The interior of the socket-barrel 17 is threaded and an externally threaded tubular retainer, generally designated 35, is screwed upwardly thereinto and is formed on its lower extremity with a radially outwardly-projecting limit shoulder 37. The lower end of such sleeve 35 tapers radially downwardly and inwardly to form a tapered finger-grip ring 38 which is knurled for positive grasping thereof. The bottom extremity of the sleeve 35 is formed with a radially inwardly-projecting retaining flange 39. A polytetrafluoroethylene retaining ring, generally designated 41, is retained behind the flange 39 and is formed on its inner diameter with a contour 43 defined by a segment of the periphery of 1¼ inch sphere to thus complimentarily mate with the spherical surface of the particular 1¼ inch diameter pivot ball 19.

The upper extremity of the interior of the retaining sleeve 35 is also formed with threads 47 and a threaded circular thrust cap, generally designated 51, is screwed thereinto to capture the ball 19 against the contoured surface 43 of the retaining ring 41. Such thrust cap 51 is formed in its top surface with a diametrical screwdriver blade-receiving slot 52 sandwiched therebetween and the ball 19 is a polytetrafluoroethylene-bearing ring, generally designated 53. The interior diameter of the retaining ring 53 is formed along a contour 55 defined by a 1¼ inch sphere with the through central diameter 57 being about 17/32 of an inch, thus decreasing the frictional engagement between the pivot ball 19 and such bearing ring over that for a continuous semispherical cap.

The cylindrical barrel 17 is formed in its back wall with a through threaded bore 61 having a set screw 63 screwed thereinto for engagement with the sleeve 35 to lock such sleeve in vertical adjustment within the housing 17.

In operation, the pivot roller assembly 11 may be mounted on the skateboard 15 during original manufacture or, as is the case in many instances, such assembly will be acquired for subsequent installation on a skateboard in a position sandwiched between the platform 21 and either the front truck 20 or the rear truck 22.

First, the screws holding the truck 22 in position are loosened and the bracket 13 moved into position with the particular holes 24 and 26 and slots 28 and 30 aligned with the particular truck mounting pattern for such truck and the mounting screws, or new longer mounting screws, inserted to secure the truck 22 in place. These screws are then tightened and the board is ready for final adjustment.

Final adjustment of the pivot ball height 19 is accomplished by loosening the set screw 63 (FIG. 4) and then grasping the adjustment ring 38 between the thumb and finger and rotating the retaining sleeve 35 between the thunb and finger and rotating the retaining sleeve 35 to back it out of the barrel 17 a distance sufficient to dispose the bottom surface of the ball 19 at the desired level above the plane of the bottom surfaces of the truck wheels 71 and 73. The skateboard 15 is then ready for use and can be used in a conventional manner.

However, when it is desirable to take advantage of the pivot roller assembly 11 to perform new maneuvers or old maneuvers in a different manner, the rider need merely shift his weight to the back of the board 15 to pivot such front extremity of the skateboard upwardly about the back wheels 71 to a degree causing the bottom of the pivot ball 19 to engage the ground, as shown in FIG. 2. This will normally occur when the board 15 is tilted to approximately 15 degrees, thus resulting in the rider's weight being applied to the ball 19 with the principal vector thereof being directed along the axis of the barrel 17. This serves to evenly load the ball 19 and minimize stress on the overall assembly and retaining arrangement.

It will be appreciated that the retainer sleeve 35 may be, from time to time, adjusted inwardly or outwardly within the housing socket 17 to adjust the ball height for different riders or different desired levels of performance.

If the ball 19 becomes worn, the bracket 13 may easily be removed by removing the rear truck 22 and access may then be had to the thrust cap 51 to enable such cap to be tightened downwardly and hold the ball 19 captive against the contoured surface 43 of the retainer ring 41.

If at some time the ball 19 becomes worn to the point that it should be replaced, the thrust cap 51 may conveniently be backed entirely out of the retainer sleeve 35, the bearing ring 53 removed and the ball 19 replaced with a new replacement ball. The bearing-ring 55 and thrust-cap 51 may then be re-inserted, and the bracket 13 again mounted on the truck 22 or 20 as desired.

Figure 7:
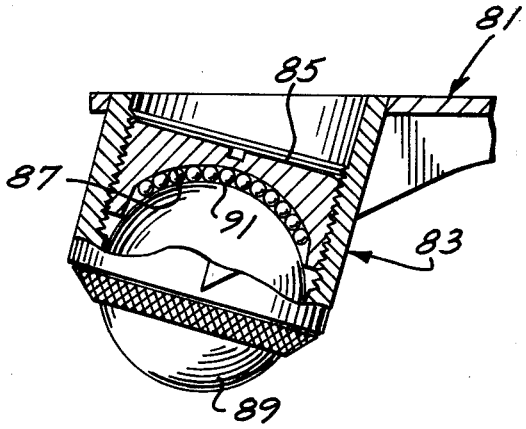
FIG. 7 is a partial side view, partially in section, of a second embodiment of the skateboard pivot roller assembly of the present invention.

Referring to FIG. 7, the pivot ball assembly shown therein is similar to that shown in FIG. 4 except that the bracket 81 is formed with a downwardly-opening socket 83 having a thrust-cap 85 received therein which is formed with a somewhat semi-spherical downwardly-facing cavity 87 which forms a dome over a pivot ball 89. Sandwiched between the dome 87 and the ball 89 are a plurality of ball bearings 91 which provide for reduction of friction during operation of the ball 89. It has been found that a steel ball 89 may conveniently be utilized with the ball-bearings 91 and such steel ball will provide long and trouble-free serviced life.

Various modifications and changes may be made with regard to the foregoing detailed description without departing from the spirit of the invention.

We claim:

1. A skateboard pivot roller assembly for mounting on the underside of a skateboard and comprising:

an elongated bracket formed with a substantially flat surface facing in one direction for mounting on the underside of a skateboard at one extremity thereof;

a barrel included at one end of said bracket and projecting in a second direction opposite said one direction to terminate in an open end and formed with a ball socket opening in said second direction and having a predetermined diameter;

a pivot ball of less than said predetermined diameter received in said socket;

thrust cap means closing the end of said socket opposite said open end and formed with a semispherical cavity opening toward said open end and lined with a low friction bearing means bearing against said pivot ball; and a retainer carried from said barrel for retaining said ball in said socket whereby said bracket may be mounted on the underside of said one extremity of said skateboard and a rider on said skateboard may shift his weight over said extremity to tilt said skateboard to lower said ball to the ground so said rider can maneuver his weight about said ball.

2. A skateboard pivot roller assembly as set forth in claim 1, wherein:

said barrel angles away from said substantially flat surface and in the direction of said one end of said bracket at an angle of substantially 75 degrees with respect to said substantially flat surface.

3. A skateboard pivot roller assembly as set forth in claim 1 wherein:

said barrel is internally threaded and said assembly includes an externally threaded retainer sleeve screwed into said barrel, said sleeve forming said socket and carrying said retainer.

4. A skateboard pivot roller assembly as set forth in claim 3 wherein:

the wall of said barrel is formed with a through internally threaded bore and said assembly includes;

a set screw screwed through said bore and engaging said sleeve.

5. A skateboard pivot roller assembly as set forth in claim 1 wherein:

said thrust cap means includes a low-friction bearing ring mounted in said socket, having an internal diameter less than that of said ball and arranged for said ball to bear thereagainst when said rider's weight is applied to said one extremity of said skateboard.

6. A skateboard pivot roller assembly as set forth in claim 1 wherein said barrel includes:

an internally threaded sleeve formed at one extremity with a retaining ring having an internal diameter less than the diameter of said ball; and wherein said thrust cap means includes an externally threaded circular thrust cap screwed into the end of said barrel opposite said one extremity to hold said ball captive against said retainer ring.

7. A skateboard pivot roller assembly as set forth in claim 1 wherein:

said thrust cap means include a semispherical thrust cap dome lined with ball bearing means for bearing thereagainst of said ball.

8. A skateboard pivot roller assembly as set forth in claim 1 wherein:

said bracket is formed with a pair of longitudinally spaced apart, bores and a pair of, transversely spaced apart slots angling outwardly and away from said one end and further including a second pair of slots disposed in the extremity of said bracket opposite said one end and angling outwardly and away from said one end.

9. A skateboard pivot roller assembly as set forth in claim 1 wherein:

said bracket is turned away from said one direction along its opposite longitudinal sides to form reenforcing flanges.

10. A skateboard pivot roller assembly as set forth in claim 1 wherein:

said barrel is internally threaded and includes an externally threaded sleeve screwed into said barrel and formed internally with said ball socket whereby said sleeve may be selectively screwed inwardly and outwardly within said barrel to adjust the location of said pivot ball relative to said skateboard.

* * * * *